US009505258B2

(12) United States Patent
Boland et al.

(10) Patent No.: US 9,505,258 B2
(45) Date of Patent: Nov. 29, 2016

(54) DYNAMIC COOLING OF PRINT MEDIA IN A RADIANT DRYER

(71) Applicants: Stuart J. Boland, Denver, CO (US); Sean K. Fitzsimons, Thornton, CO (US); Scott Johnson, Erie, CO (US); William Edward Manchester, Erie, CO (US); Casey E. Walker, Boulder, CO (US)

(72) Inventors: Stuart J. Boland, Denver, CO (US); Sean K. Fitzsimons, Thornton, CO (US); Scott Johnson, Erie, CO (US); William Edward Manchester, Erie, CO (US); Casey E. Walker, Boulder, CO (US)

(73) Assignee: Ricoh Company, Ltd., Tokyo (JP)

( * ) Notice: Subject to any disclaimer, the term of this patent is extended or adjusted under 35 U.S.C. 154(b) by 386 days.

(21) Appl. No.: 13/781,172

(22) Filed: Feb. 28, 2013

(65) Prior Publication Data

US 2014/0237844 A1 Aug. 28, 2014

(51) Int. Cl.

| | |
|---|---|
| ***F26B 3/34*** | (2006.01) |
| ***F26B 3/32*** | (2006.01) |
| ***B41M 7/00*** | (2006.01) |
| ***F26B 3/28*** | (2006.01) |
| ***F26B 21/00*** | (2006.01) |

(52) U.S. Cl.

CPC ..... *B41M 7/009* (2013.01); *F26B 3/28* (2013.01); *F26B 3/283* (2013.01); *F26B 21/004* (2013.01)

(58) Field of Classification Search

CPC .... F26B 13/007; F26B 13/108; F26B 3/283; F26B 3/024; F26B 21/004; F26B 21/06; B41M 7/009; B41J 2/162

USPC ..... 34/486, 444, 443, 565, 267, 269, 271, 34/274, 278, 428, 66, 62; 347/18, 19, 102, 347/103

See application file for complete search history.

(56) References Cited

U.S. PATENT DOCUMENTS

| | | | | |
|---|---|---|---|---|
| 4,550,324 | A * | 10/1985 | Tamaru | B41J 2/00 250/318 |
| 5,214,442 | A * | 5/1993 | Roller | B41J 11/002 101/424.1 |
| 6,427,594 | B1 | 8/2002 | Secor et al. | |
| 7,907,873 | B2 | 3/2011 | Sandler et al. | |
| 8,328,321 | B2 | 12/2012 | Tsuzawa | |
| 8,573,768 | B2 * | 11/2013 | Onishi et al. | 347/103 |
| 2012/0098882 | A1 | 4/2012 | Onishi et al. | |
| 2012/0287196 | A1 | 11/2012 | Boland et al. | |

* cited by examiner

*Primary Examiner* — Kenneth Rinehart
*Assistant Examiner* — John McCormack
(74) *Attorney, Agent, or Firm* — Duft Bornsen & Fettig LLP

(57) ABSTRACT

Systems and methods provide targeted cooling for portions of print media during a radiant drying process. One embodiment comprises a radiant dryer and a control system. The radiant dryer includes a radiant energy source within an interior of the radiant dryer that dries a colorant onto a continuous-form medium. The radiant dryer further includes a plurality of independently actuated cooling jets within the interior that apply a cooling gas to the medium. The control system determines regions on the medium where the colorant is at risk of overheating, and directs the cooling jets to apply the cooling gas to the regions.

15 Claims, 6 Drawing Sheets

DYNAMIC COOLING OF PRINT MEDIA IN A RADIANT DRYER

FIELD OF THE INVENTION

The invention relates to the field of printing systems, and in particular, to radiant drying of print medium.

BACKGROUND

Businesses or other entities having a need for volume printing typically purchase a production printer. A production printer is a high-speed printer used for volume printing, such as 100 pages per minute or more. The production printers are typically continuous-form printers that print on paper or some other printable medium that is stored on large rolls.

A production printer typically includes a localized print controller that controls the overall operation of the printing system, a print engine (sometimes referred to as an "imaging engine" or as a "marking engine"), and a dryer. The print engine includes one or more printhead assemblies, with each assembly including a printhead controller and a printhead (or array of printheads). An individual printhead includes multiple tiny nozzles (e.g., 360 nozzles per printhead depending on resolution) that are operable to discharge colorants as controlled by the printhead controller. The printhead array is formed from multiple printheads that are spaced in series along a particular width so that printing may occur across the width of the medium. The dryer is used to heat the medium and colorant to dry the colorant. In some printing systems, the dryer is a radiant dryer, and may include a number of lamps or emitters that radiate infra-red energy to heat the medium and/or colorant.

In radiant dryers that apply a great deal of heat over a short period of time, it remains a problem to ensure that the medium is properly dried. Too much heat can cause the medium to char or burn. At the same time, too little heat can result in the colorant on the medium remaining wet, resulting in smearing or offsetting that reduces the print quality of jobs. Further, large variations in temperatures across the medium can arise during the drying process due to the varying densities of the colorants applied to the medium and variations in the energy absorption characteristics of the colorants.

SUMMARY

Embodiments described herein provide targeted cooling for portions of a print media during a radiant drying process. During the radiant drying process, localized hot spots may occur on the media due to differences in how energy is absorbed. Targeted cooling reduces the temperatures of the localized hot spots, and therefore, reduces the possibility of scorching the media. Also, as variations in the temperature across the media are reduced, higher power drying can occur to ensure that the media is sufficiently dry.

One embodiment is an apparatus that includes a radiant dryer and a control system. The radiant dryer includes a radiant energy source within an interior of the radiant dryer that is operable to dry a colorant onto a continuous-form medium. The radiant dryer further includes a plurality of independently actuated cooling jets within the interior that are operable to apply a cooling gas to the medium. The control system is operable to determine regions on the medium where the colorant is at risk of overheating, and to direct the cooling jets to apply the cooling gas to the regions.

Another embodiment is a method for targeted cooling of portions of a print media during a radiant drying process. The method comprises drying a colorant onto a continuous-form medium using a radiant energy source within an interior of a radiant dryer. The method further comprises determining regions on the medium where the colorant is at risk of overheating, and directing a plurality of independently actuated cooling jets within the interior of the dryer to apply a cooling gas to the regions.

Another embodiment is a non-transitory computer readable medium embodying programmed instructions executable by a processor. The instructions direct the processor to dry a colorant onto a continuous-form medium using a radiant energy source within an interior of a radiant dryer. The instructions further direct the processor to determine regions on the medium where the colorant is at risk of overheating, and to control a plurality of independently actuated cooling jets within the interior of the dryer to apply a cooling gas to the regions.

Other exemplary embodiments may be described below.

BRIEF DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
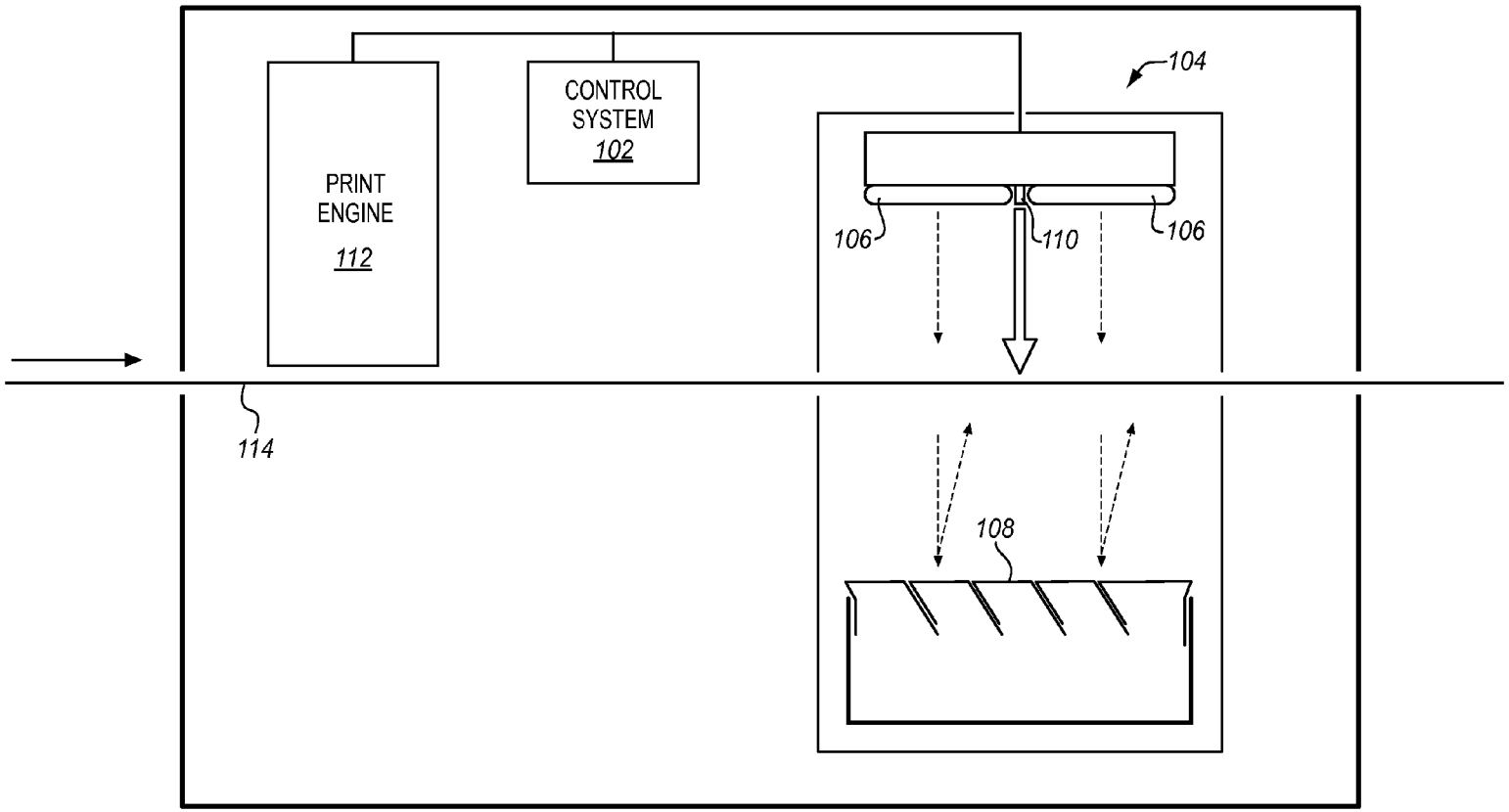
FIG. 1 is a block diagram of a printing system in an exemplary embodiment.

FIG. 1 is a block diagram of a printing system 100 in an exemplary embodiment. In this embodiment, printing system 100 includes a control system 102, a radiant dryer 104, and a print engine 112. A web of print media 114 traverses a media path through printing system 100 in the direction indicated by the arrow in FIG. 1. During the printing process, media 114 travels along the media path proximate to print engine 112 for marking with a wet colorant, such as aqueous inks Media 114, now wet with the colorant, continues along the media path and has heat applied to media 114 by radiant dryer 104 to affix the colorant to media 114. Media 114 continues along the media path downstream of radiant dryer 104 where a number of post-processing activities may occur (e.g., cutting, stapling, folding, binding, mailing, etc.).

In this embodiment, radiant dryer 104 includes one or more radiant energy sources 106 and a reflector 108 that apply heat to media 114 and the applied colorant as media 114 traverses the interior of radiant dryer 104. Energy source 106 is typically a high power (e.g., 1-5 kilowatt) near infra-red lamp or some other type of emission source that radiantly heats media 114 and the colorant(s) applied to media 114.

One problem with prior printing systems is that hot spots arise on a web of print media during the drying process due to differences in colorant densities and/or energy absorption rates of the colorants. For example, some sections of the web may have high colorant coverage and/or be marked with colorants that absorb more radiant energy during the drying process. These sections may then become much hotter than other sections of the web. This may cause problems in prior printing systems as some sections of the web may scorch while other sections of the web are not sufficiently dry.

Figure 6:
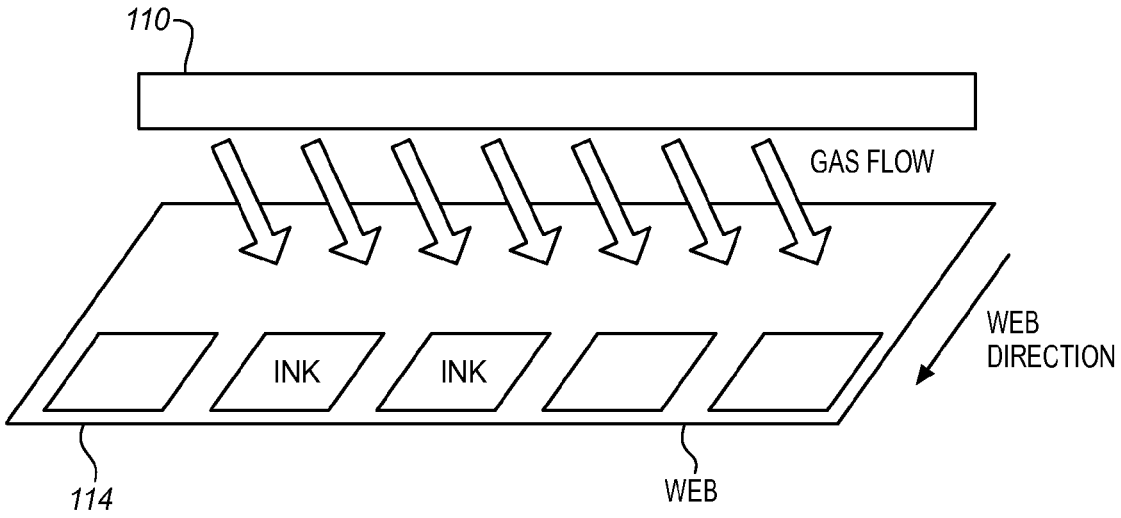
FIG. 6 is a block diagram of the cooling jets of the printing system of FIG. 1 in an exemplary embodiment.

In this embodiment, radiant dryer 104 includes a plurality of independently actuated cooling jets 110 within the interior of radiant dryer 104. Cooling jets 110 are able to apply a cooling gas (e.g., air) onto a plurality of locations of media 114. For instance, cooling jets 110 may be oriented in a line traversing the direction of travel of media 114, as illustrated in FIG. 6. Further, cooling jets 110 may be organized into groups in a number of ways as a matter of design choice. For instance, cooling jets 110 may be organized such that one group of cooling jets 110 may be actuated while another group may not. Further, each of the cooling jets 110 that share a particular group may operate together as a group. FIG. 6 is a block diagram of cooling jets 110 of the printing system of FIG. 1 in an exemplary embodiment.

In some embodiments, cooling jets 110 may be oriented in a pattern relative to media 114, such as a 2-dimensional array or grid. Cooling jets 110 are coupled with a gas manifold (not shown), which may include valves, solenoids, or other types of gas metering systems that are utilized to allow cooling jets 110 to operate independently.

In this embodiment, control system 102 determines regions on media 114 where the colorants applied are at risk of overheating, and directs cooling jets 110 to independently apply a cooling gas to the regions. For example, in a CMYK printing system, the colorants used are Cyan, Magenta, Yellow, and Key black. Key black colorants, or other relatively high energy absorbing fluids, absorb more energy per unit time from energy source 106 than the other CMY colorants. Thus, control system 102, in directing cooling gas to regions of media 114, may control cooling jets 110 to apply more cooling gas to a region on media 114 that includes mostly Key black colorant as compared to a region that includes mostly CMY colorants. This type of targeted cooling for portions of media 114 reduces the large variations in temperatures due to localized heating of media 114 during the drying process, thus reducing the possibility of scorching media 114. Further, as the hotspots on media 114 are reduced in temperature, higher power drying can be performed, which reduces the possibility that some portions of media 114 will be under-dried as media 114 exits radiant dryer 104.

Consider an example whereby a print operator is tasked with printing a job at printing system 100, which has been enhanced to provide targeted cooling of media 114 during the drying process. The print operator may specifically select printing system 100 based on the combination of colorants and print media specified in a job ticket for the print job, especially in cases where the combination is more prone to scorch or burn during the drying process. The print operator initiates printing of the job, which causes media 114 to traverse along a media path through printing system 100 in the direction indicated by the arrow in FIG. 1. Print engine 112 marks media 114 with a colorant based on the print data for the job, and media 114 is directed along the media path into the interior of radiant dryer 104.

Figure 2:
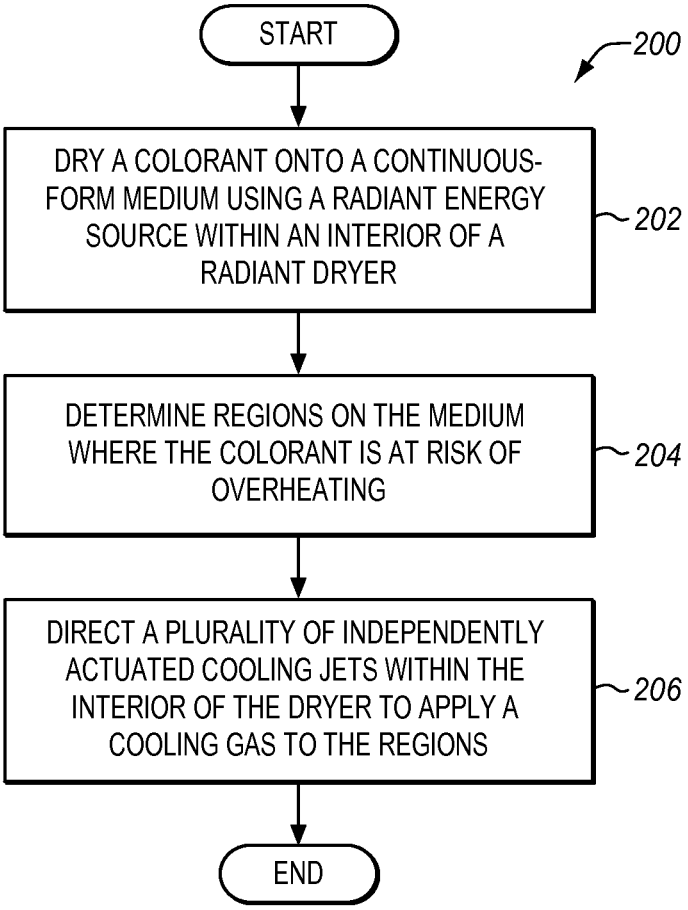
FIG. 2 is a flowchart illustrating a method for targeted cooling of print media during a radiant drying process in an exemplary embodiment.

FIG. 2 is a flowchart illustrating a method for targeted cooling of a print media during a radiant drying process in an exemplary embodiment. The steps of method 200 will be described with reference to printing system 100 of FIG. 1, but those skilled in the art will appreciate that method 200 may be performed in other systems. The steps of the flowchart(s) described herein are not all inclusive and may include other steps not shown. The steps described herein may also be performed in an alternative order.

In step 202, radiant dryer 104 dries the colorant(s) applied to media 114 utilizing energy source 106 as media 114 traverses the interior of radiant dryer 104. During the drying process, the colorants and media 114 absorb energy from energy source 106 and begin to heat up. As the colorants heat, a carrier fluid (e.g., water) in the colorants vaporize. However, some colorants absorb more radiated energy per unit time from energy source 106 than other colorants. Thus, as media 114 traverses the interior of radiant dryer 104, the colorants applied to media 114 may dry at different rates. Further, as the carrier fluids in the colorants vaporize, the now-dry colorants may begin to heat excessively, which produces hot spots on media 114.

In step 204, control system 102 determines regions on media 114 where the colorants are at risk of overheating. Control system 102 may determine the risk of overheating for a region number of different ways. For instance, control system 102 may capture image data of media 114 and determine the risk of overheating based on the colorant and/or the density of the colorants applied to media 114. In another example, control system 102 may directly measure the temperatures of different regions of media 114 and determine the risk of overheating based on the temperatures. In another example, control system 102 may analyze the print data utilized by print engine 112 to mark media 114, and identify a colorant or a combination of colorants that is marked to the region. Using the colorant information, control system 102 may determine the risk of overheating for a particular region based on the radiant absorption characteristics of the specific colorants marked to the region by print engine 112 and the radiant emission characteristics of the drying system.

In step 206, control system 102 directs cooling jets 110 to apply the cooling gas to the regions. For instance, if control system 102 determines that a risk of overheating for a particular region is high, such as when the region may absorb radiated energy from energy source 106 at a high rate, then control system 102 may direct cooling jets 110 to apply the cooling gas to the region over a longer time frame and/or at a higher volume as compared to other regions on media 114.

Figure 3:
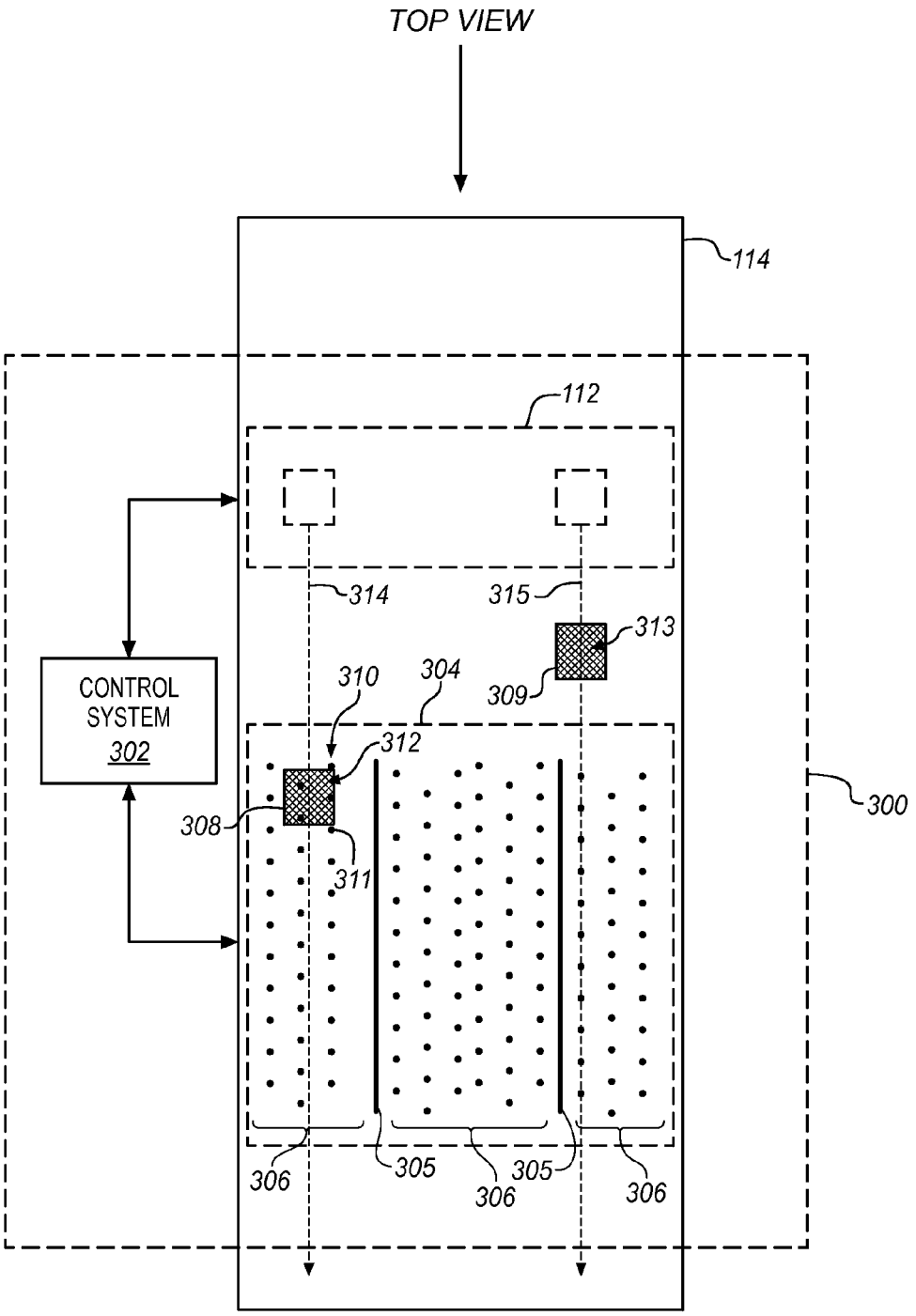
FIG. 3 is a block diagram of another printing system in an exemplary embodiment.

FIG. 3 is a block diagram of another printing system 300 in an exemplary embodiment. FIG. 3 illustrates a top view of printing system 300. Printing system 300 includes print engine 112, previously described with respect to printing system 100. In this embodiment, printing system 300 further includes a control system 302 and a radiant dryer 304. Radiant dryer 304 includes a plurality of radiant emitters 305 that traverse the interior of radiant dryer 304, as illustrated by heavy black lines in FIG. 3. Radiant emitters 305 generate Infra-Red (IR), Near IR (NIR), etc., energy to radiantly heat media 114 and the colorants applied to media 114 as media 114 traverses the interior of radiant dryer 304. Radiant dryer 304 further includes a plurality of cool gas jets 306 that are distributed in a 2-dimensional array in this embodiment within the interior of radiant dryer 304. Jets 306 are illustrated as a plurality of dots in FIG. 3. Further, jets 306 are independently controllable to direct a cooling gas onto unique portions of media 114. For instance, jets 306 may be staggered or otherwise oriented such that one portion of media 114 may be impinged with the cooling gas while an adjacent portion of media 114 may not be impinged with the cooling gas.

In FIG. 3, media 114 travels in the direction indicated by the arrow. During a printing process, print engine 112 applies a colorant or a plurality of colorants to media 114, and media 114 travels along a media path through printing system 300 towards radiant dryer 304.

Figure 4:
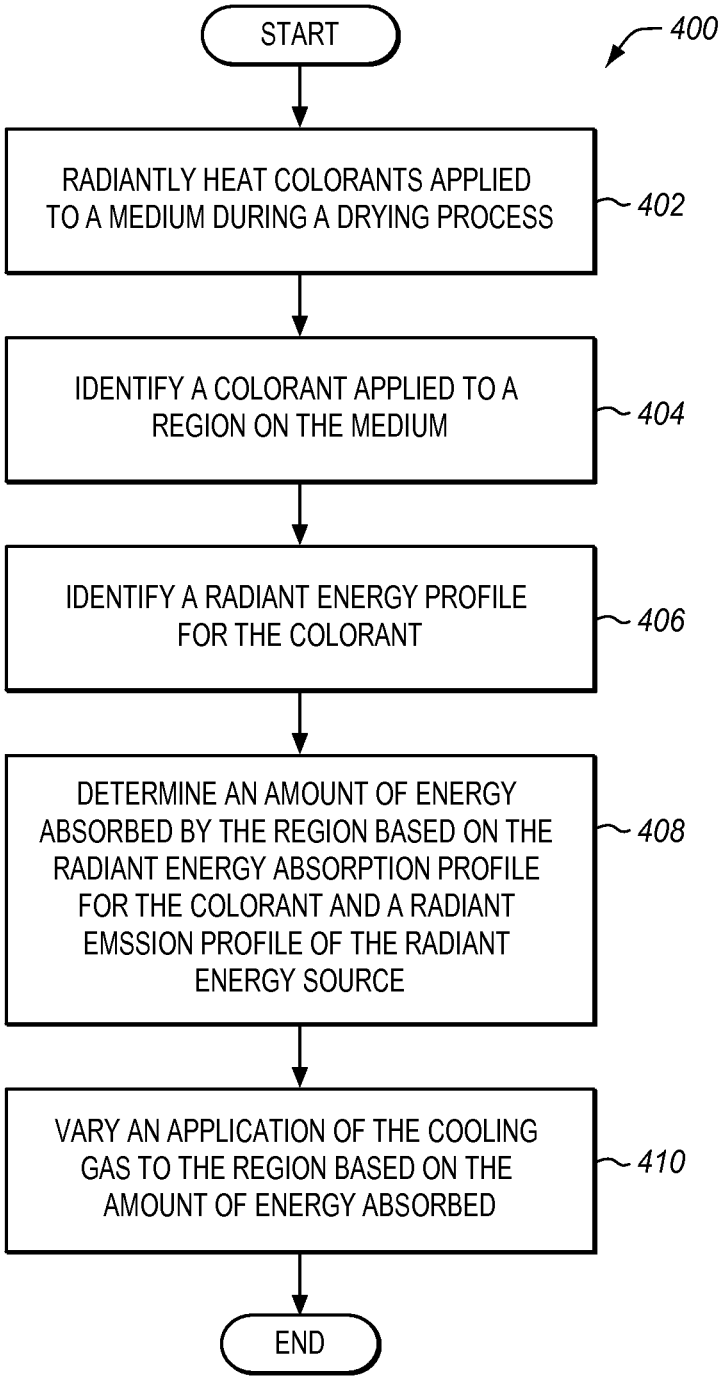
FIG. 4 is a flowchart illustrating a method for targeted cooling of print media for the printing system of FIG. 3 in an exemplary embodiment.

FIG. 4 is a flowchart illustrating a method for targeted cooling of media 114 for printing system 300 in an exemplary embodiment. The steps of method 400 will be described with reference to printing system 300 of FIG. 3, but those skilled in the art will appreciate that method 400 may be performed in other systems.

In step 402, radiant dryer 304 radiantly heats the colorant(s) applied to media 114 utilizing emitters 305 as media 114 traverses the interior of radiant dryer 304. The colorants absorb radiated energy from emitters 305, and undergo a drying process.

In step 404, control system 302 identifies one or more colorants applied to regions on media 114. FIG. 3 illustrates two regions 308-309 on media 114. In this embodiment, region 308 has colorant 312 applied by print engine 112, and region 309 has colorant 313 applied by print engine 112. Dashed arrows in FIG. 3 proximate to regions 308-309 illustrate the respective paths 314-315 that regions 308-309 will take through printing system 300. To identify colorants 312-313 in step 404, control system 302 may process the bitmap data utilized by print engine 112 in marking regions 308-309 to determine the corresponding colorants 312-313.

In step 406, control system 302 identifies radiant energy absorption profiles for colorants 312-313. The absorption profiles, also referred to absorption curves, describe variation in absorbed radiation as a function of wavelength. Generally, different colorants exhibit different absorption profiles, where some colorants absorb a significantly greater amount of energy than other colorants at the same wavelength. This information could be characterized for a specific set of printing colorants and input into the control system (e.g., via aE lookup table).

In step 408, control system 302 determines the amount of energy absorbed by regions 308-309 based on the absorption profiles for their respective applied colorants 312-313 and a radiant emission profile for emitters 305. For instance, region 308, marked with colorant 312, may absorb much more energy from emitters 305 during the drying process than region 308, marked with colorant 313. Further, the spectral output of emitters 305 may vary over time as emitters 305 accrue hours of operation. Thus, the spectral output may be periodically checked and this information updated at printing system 300 for use by control system 302 to more accurately calculate the energy absorbed by the various colorants utilized by printing system 300.

In step 410, control system 302 varies an application of the cooling gas (e.g., an activation time) via one or more jets 306 to regions 308-309 based on the amount of energy absorbed by regions 308-309. To control jets 306 to vary an application of the cooling gas, control system 302 may first compare media paths 314-315 with known locations of jets 306 and determine, as a function of time, how a subset of jets 306 (e.g., jets 308-309) are controlled to apply different amounts of cooling gas to regions 308-309 based on the amount of energy absorbed by regions 308-309. For instance, jet 310, which is illustrated in FIG. 3 as upstream of region 308 (as indicated by the direction of media 114 through printing system 300), may be off or in the process of turning off for the specific snapshot in time captured by FIG. 3. In like manner, jet 311, which is illustrated in FIG. 3 as nearly centered along an edge of region 308, may be on for the specific snapshot in time captured by FIG. 3. Further, jet 312, which is illustrated in FIG. 3 as downstream of region 308, may be on or in the process of turning on for the specific snapshot in time captured by FIG. 3. Thus as a function of time, various jets 306 may be on or off to provide targeted cooling to region 308 as region 308 traverses the interior of radiant dryer 304. A similar process may occur for a subset of jets 306 that lie along path 315 as region 313 traverses the interior of radiant dryer 304.

Figure 5:
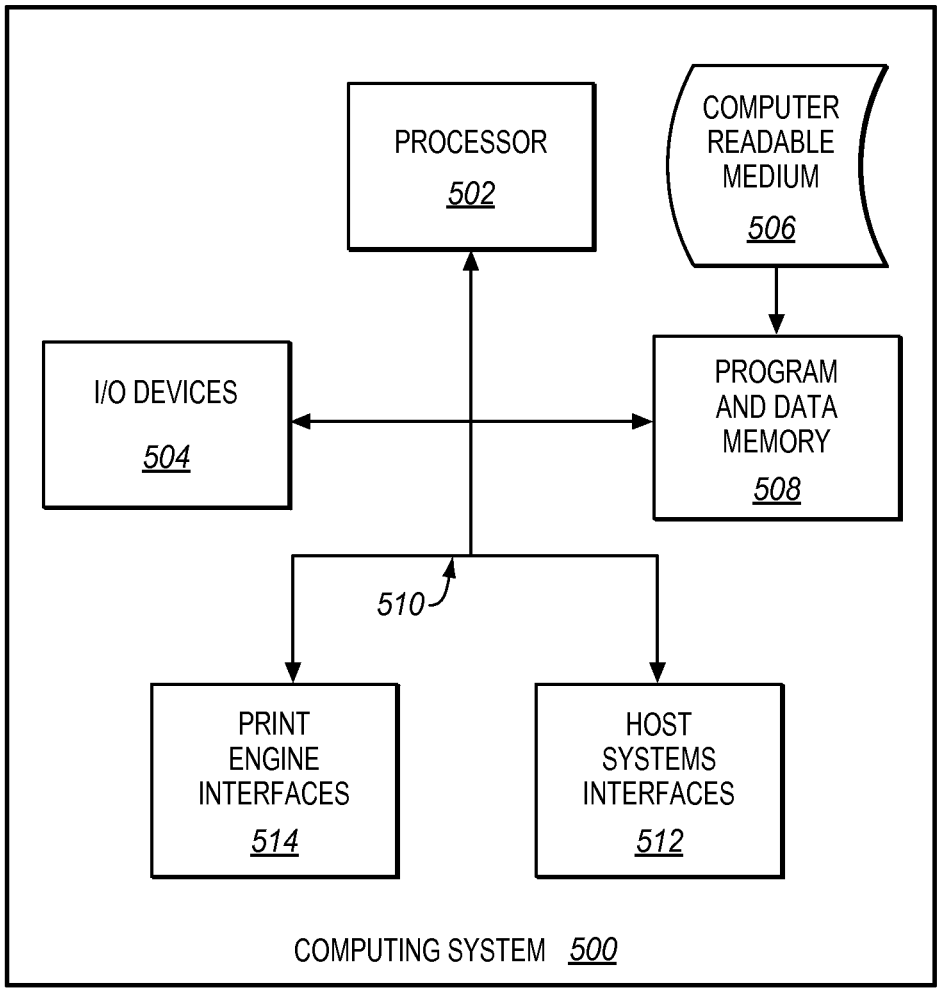
FIG. 5 illustrates a processing system operable to execute a computer readable medium embodying programmed instructions to perform desired functions in an exemplary embodiment.

The invention can take the form of an entirely hardware embodiment, an entirely software embodiment or an embodiment containing both hardware and software elements. In one embodiment, the invention is implemented in software, which includes but is not limited to firmware, resident software, microcode, etc. FIG. 5 illustrates a computing system 500 in which a computer readable medium may provide instructions for performing the methods of FIG. 2 and FIG. 4 in an exemplary embodiment.

Furthermore, the invention can take the form of a computer program product accessible from a computer-usable or computer-readable medium 506 providing program code for use by or in connection with a computer or any instruction execution system. For the purposes of this description, a computer-usable or computer readable medium 506 can be any apparatus that can contain, store, communicate, or transport the program for use by or in connection with the instruction execution system, apparatus, or device.

The medium 506 can be an electronic, magnetic, optical, electromagnetic, infrared, or semiconductor system (or apparatus or device) or a propagation medium. Examples of a computer-readable medium 506 include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include one or more processors 502 coupled directly or indirectly to memory 508 through a system bus 510. The memory 508 can include local memory employed during actual execution of the program code, bulk storage, and cache memories which provide temporary storage of at least some program code in order to reduce the number of times code is retrieved from bulk storage during execution.

Input/output or I/O devices 504 (including but not limited to keyboards, displays, pointing devices, etc.) can be coupled to the system either directly or through intervening I/O controllers.

Network adapters may also be coupled to the system to enable the data processing system to become coupled to other data processing systems, such a through host systems interfaces 512, or remote printers or storage devices through intervening private or public networks. Modems, cable modem and Ethernet cards are just a few of the currently available types of network adapters. Computing system 500 further includes print engine interfaces 514.

Although specific embodiments were described herein, the scope of the invention is not limited to those specific embodiments. The scope of the invention is defined by the following claims and any equivalents thereof.

We claim:

1. A method comprising:

drying a colorant applied onto a continuous-form paper using a radiant energy source within an interior of a radiant dryer;

identifying a colorant applied to a region on the paper;

identifying a radiant energy absorption profile for the colorant;

determining a risk of overheating for the region based on the identified colorant and the radiant energy absorption profile for the identified colorant; and directing a plurality of independently actuated cooling jets within the interior of the radiant dryer to apply a cooling gas to the region.

2. The method of claim 1 wherein:

determining regions where the colorant is at risk further comprises:

determining an amount of energy absorbed by the region based on the radiant energy absorption profile of the identified colorant and a radiant emission profile of the radiant energy source; and directing the plurality of cooling jets further comprises:

varying an application of the cooling gas to the region based on the amount of energy absorbed.

3. The method of claim 1 wherein:

determining regions where the colorant is at risk further comprises:

identifying a plurality of colorants applied to the region on the paper;

identifying a composite absorption profile for the plurality of colorants; and determining the risk of overheating for the region based on the identified colorants and the radiant energy absorption profile for the identified colorants.

4. The method of claim 1 wherein:

the plurality of cooling jets are organized as a 2-dimensional array of independently actuated cooling jets within the interior of the radiant dryer; and directing the plurality of cooling jets further comprises:

identifying a subset of the 2-dimensional array of cooling jets that are proximate to the region; and directing the subset of cooling jets to apply the cooling gas to the region.

5. The method of claim 4 wherein:

directing the plurality of cooling jets further comprises:

varying at least one of an activation time, a flow rate, and a velocity of the cooling gas for the subset of cooling jets based on the risk of overheating for the region.

6. A non-transitory computer readable medium embodying programmed instructions executable by a processor, the instructions operable to direct the processor to:

dry a colorant applied onto a continuous-form paper using a radiant energy source within an interior of a radiant dryer;

identify a colorant applied to a region on the paper;

identify a radiant energy absorption profile for the colorant;

determine a risk of overheating for the region based on the identified colorant and the radiant energy absorption profile for the identified colorant; and direct a plurality of independently actuated cooling jets within the interior of the radiant dryer to apply a cooling gas to the region.

7. The non-transitory computer readable medium of claim 6 wherein:

instructions to determine regions where the colorant is at risk further comprise instructions to:

determine an amount of energy absorbed by the region based on the radiant energy absorption profile of the identified colorant and a radiant emission profile of the radiant energy source; and instructions to direct the plurality of cooling jets further comprise instructions to:

varying an application of the cooling gas to the region based on the amount of energy absorbed.

8. The non-transitory computer readable medium of claim 6 wherein:

instructions to determine regions where the colorant is at risk further comprise instructions to:

identify a plurality of colorants applied to the region on the paper;

identify a composite absorption profile for the plurality of colorants; and determine the risk of overheating for the region based on the identified colorants and the radiant energy absorption profile for the identified colorants.

9. The non-transitory computer readable medium of claim 6 wherein:

the plurality of cooling jets are organized as a 2-dimensional array of independently actuated cooling jets within the interior of the radiant dryer; and instructions to direct the plurality of cooling jets further comprise instructions to:

identify a subset of the 2-dimensional array of cooling jets that are proximate to the region; and direct the subset of cooling jets to apply the cooling gas to the region.

10. The non-transitory computer readable medium of claim 9 wherein:

instruction to direct the plurality of cooling jets further comprise instructions to:

vary at least one of an activation time, a flow rate, and a velocity of the cooling gas for the subset of cooling jets based on the risk of overheating for the region.

11. An apparatus comprising:

a radiant dryer of a printing system, the radiant dryer including:

a radiant energy source within an interior of the radiant dryer that is operable to dry a colorant applied onto a continuous-form paper; and a plurality of independently actuated cooling jets within the interior of the radiant dryer that are operable to apply a cooling gas to the paper and the colorant applied thereto; and a control system operable to identify a colorant applied to a region on the paper, to identify a radiant energy absorption profile for the colorant, to determine a risk of overheating for the region based on the identified colorant and the radiant energy absorption profile for the identified colorant, and to direct the cooling jets to apply the cooling gas to the region.

12. The apparatus of claim 1 wherein:

the control system is further operable to determine an amount of energy absorbed by the region based on the radiant energy absorption profile of the identified colorant and a radiant emission profile of the radiant energy source, and to vary an application of the cooling gas to the region based on the amount of energy absorbed.

13. The apparatus of claim 1 wherein:

the control system is further operable to identify a plurality of colorants applied to the region on the paper, to identify a composite absorption profile for the plurality of colorants, and to determine the risk of overheating for the region based on the identified colorants and the radiant energy absorption profile for the identified colorants.

14. The apparatus of claim 1 wherein:

the plurality of cooling jets are organized as a 2-dimensional array of independently actuated cooling jets within the interior of the radiant dryer; and the control system is further operable to identify a subset of the 2-dimensional array of cooling jets that are proximate to the region, and to direct the subset of cooling jets to apply the cooling gas to the region.

15. The apparatus of claim 14 wherein:

the control system is further operable to vary at least one of an activation time, a flow rate, and a velocity of the cooling gas for the subset of cooling jets based on the risk of overheating for the region.

* * * * *